US007942285B2

(12) United States Patent
Hasegawa et al.

(10) Patent No.: US 7,942,285 B2
(45) Date of Patent: May 17, 2011

(54) EASILY-OPENABLE CAN LID

(75) Inventors: Wataru Hasegawa, Sagamihara (JP); Yoshihiko Matsukawa, Sagamihara (JP)

(73) Assignee: Daiwa Can Company, Tokyo (JP)

( * ) Notice: Subject to any disclaimer, the term of this patent is extended or adjusted under 35 U.S.C. 154(b) by 859 days.

(21) Appl. No.: 11/908,353

(22) PCT Filed: Nov. 28, 2005

(86) PCT No.: PCT/JP2005/021826

§ 371 (c)(1),
(2), (4) Date: Sep. 11, 2007

(87) PCT Pub. No.: WO2006/100803

PCT Pub. Date: Sep. 28, 2006

(65) Prior Publication Data

US 2008/0197132 A1 Aug. 21, 2008

(30) Foreign Application Priority Data

Mar. 22, 2005 (JP) ..... 2005-082156

(51) Int. Cl.
*B65D 17/34* (2006.01)
*B65D 17/00* (2006.01)

(52) U.S. Cl. ..... 220/269; 220/270; 220/271

(58) Field of Classification Search ..... 220/269, 220/270, 271–273; 413/12, 14–16
See application file for complete search history.

(56) References Cited

U.S. PATENT DOCUMENTS

| | | | | |
|---|---|---|---|---|
| 3,227,304 | A * | 1/1966 | Ashury | 220/268 |
| 3,945,334 | A * | 3/1976 | Ostrem et al. | 413/12 |
| 5,038,956 | A * | 8/1991 | Saunders | 220/271 |
| 2007/0131693 | A1 * | 6/2007 | Matsukawa et al. | 220/269 |

FOREIGN PATENT DOCUMENTS

| | | |
|---|---|---|
| JP | 2 180148 | 7/1990 |
| JP | 2 502814 | 9/1990 |
| JP | 2003 509306 | 3/2003 |
| JP | 2004 155480 | 6/2004 |

* cited by examiner

*Primary Examiner* — Robin Hylton
(74) *Attorney, Agent, or Firm* — Oblon, Spivak, McClelland, Maier & Neustadt, L.L.P.

(57) ABSTRACT

An easy open can lid comprises an outer multilayered portion folded into three layers and enclosing the panel portion from outside of the score line, and an inner multilayered portion folded into three layers and enclosing the panel portion from inside of the score line. A leading edge of an outer protection portion as a folding portion between the first and second outer layers is flush with or situated outside of the score line, and a leading edge of an inner protection portion as a folding portion between the second and third inner layers is flush with or situated inside of the score line. An opening width of an inner interspace between the first and second inner layers is wider than that of an outer interspace between the second and third outer layers.

4 Claims, 2 Drawing Sheets

EASILY-OPENABLE CAN LID

TECHNICAL FIELD

This invention relates to a full-open type easy open can lid, and more specifically, to an easy open can lid provided with a member for covering a edge of a ruptured score line to be created after the can lid is opened (i.e., a guard portion), in order to protect a hand from the edge of the ruptured score line when opening a can and when taking out contents from the can.

BACKGROUND ART

In the prior art, a so-called full-open type can lid is widely employed as a can lid of a can which needs to have a wide opening to take out contents, such as a canned fruit, a canned fish, a canned beef, a canned vegetables and so on. According to the full-open type can lid, an opening piece is enclosed by a score line drawn along a periphery of a panel portion of a can lid, and a tab for rupturing the score line to take out the contents is fixed on the opening piece.

As a conventional art of this kind of full-open type can lid, Japanese Patent Laid-Opens No. 2-180148 and No. 2-502814 disclose techniques to form a multilayered folded portion covering an edge of a ruptured score line, for the purpose of preventing a hand or fingers of a can opener to be injured by a broken edge of the opening piece or an edge of the ruptured score line at an opening operation of the can or when taking out the contents from the can.

However, according to the vessel lid with a safe opening edge taught by Japanese Patent Laid-Open No. 2-180148, folded portions are situated across the score line to cover an opening edge of the score line. Therefore, the opening edge will be contacted with the folded portion when opening the can, otherwise, the folded portions will be contacted to interfere with each other. For this reason, an excessive force is required to open the can lid and this deteriorates an openability of the can.

Meanwhile, according to the can lid taught by Japanese Patent Laid-Open No. 2-502814, although a leading edge of the folded portion is not situated across the score line, a clearance between a surface where the score line is drawn and an outer folded portion is maintained widely as illustrated therein. For this reason, stiffness in the vicinity of a panel portion is insufficient and the openability thereof is also less than perfect. Additionally, clearances between each layers of an inner folded portion are narrowed. This makes a forming of the folded portion difficult and deteriorates a quality of an inner surface of the can lid.

DISCLOSURE OF THE INVENTION

The present invention has been conceived noting the technical background as thus far described, and its object is to provide an easy open can lid with an excellent openability, which is capable of protecting a hand of consumers from an edge of the ruptured score line to be created after the can is opened.

In order to achieve the above-mentioned object, the easy open can lid of the present invention comprises features to be explained in the following. Specifically, the easy open can lid of the invention comprises: a panel portion, which is formed of an approximate disc shape, and in which a flange portion for fixing a can trunk is formed integrally on its outer circumference; an opening piece, which is enclosed by a suborbicular score line drawn near the periphery of the panel portion;

and an opening tab, which is fixed near the periphery of the opening piece. In the periphery of the panel portion, an outer multilayered portion situated radially outside of the score line, and an inner multilayered portion situated radially inside of the score line. The outer multilayered portion comprises an annular first outer layer extending inwardly in the radial direction from the flange portion, an annular second outer layer extending outwardly in the radial direction from a folding portion of the first outer layer situated in the vicinity of the score line, and an annular third outer layer extending inwardly in the radial direction from a folding portion of the second outer layer. Meanwhile, the inner multilayered portion comprises an annular first inner layer extending inwardly in the radial direction from the score line, an annular second inner layer extending outwardly in the radial direction from a folding portion of the first inner layer, and a third inner layer extending inwardly in the radial direction from a folding portion of the second inner layer. A leading edge of an outer protection portion as a folding portion between the first and second outer layers is situated on an outer surface of the can lid, i.e., on the surface opposite to the surface where the score line is drawn, and also, situated flush with the score line in the radial direction or radially outside of the score line. On the other hand, a leading edge of an inner protection portion as a folding portion between the second and third inner layers is situated on an inner surface of the can lid, i.e., on the same surface where the score line is drawn, and also, situated flush with the score line in the radial direction or radially inside of the score line. Additionally, an opening width of an inner interspace between the first and second inner layers is wider than that of an outer clearance between the second and third outer layers.

Here, according to the invention, a definition of the suborbicular score line includes not only a score line drawn continuously all along the periphery of the panel portion to detach the panel portion completely from the can lid by an opening operation of the can, but also a partially omitted score line for opening the panel portion at least more than half area, as well as a score line comprising a portion where a residual thickness is partially thicker than that of the remaining portion so as not to detach the opening piece completely from the can lid even if the can lid is opened.

In addition to the above structure, the present invention is characterized in that a radial distance between the leading edge of the outer protection portion and the score line, and a radial distance between the leading edge of the inner protection portion and the score line are 0 to 1 mm.

The present invention is further characterized in that the score line is formed by pressing a score die against the inner surface of the can lid.

According to the invention, therefore, the edge of the ruptured score line and the protection portion are not contacted with each other when opening the can lid, and this contributes to improve an openability of the can lid. Also, since the outer interspace is relatively narrower, deformation volume of the folding portion between the second and third outer layers or the outer protection portion is increased. Therefore, a work hardening of the outer multilayered portion is increased so that a stiffness of the peripheral portion of the panel is improved. For this reason, opening force created by the tab is transmitted efficiently to the score line. As a result, the openability of the lid is improved. On the other hand, since the inner interspace is relatively wider, deformation volume of the folding portion between the first and second inner layers or the inner protection portion is decreased. For this reason, an inner coating of the inner multilayered portion is prevented from being damaged during a forming process. As a result, the inner surface of the can lid is prevented from corrosion.

Moreover, according to the invention, the edge of the ruptured score line and the protection portion are not contacted when opening the lid as mentioned above. Therefore, the openability of the can lid is improved, and a protruding length of the edge of the ruptured score line can be kept within a safety range.

Further, according to the invention, the score line is formed by pressing a score die against the inner surface of the can lid, and the interspace of the inner multilayered portion is relatively wider than that of the outer multilayered portion. For this reason, a touch up work after the score line is drawn to apply a coating compound to the score line can be carried out easily and certainly.

In case of drawing the score line on the outer surface of the can lid, the inner surface of the can lid is somewhat damaged as a result of pressing a forming tool such as a score anvil thereon when drawing the score line. Therefore, it is necessary to touch up both outer and inner surfaces of the can lid in the vicinity of the score line by applying a coating compound. To the contrary, according to the invention, the score line is drawn on the inner surface of the can lid. Therefore, a touch up work is required only for the inner surface of the can lid. Meanwhile, since the outer surface will not be contacted with the contents, a touch up work of the outer surface is not necessary even if the outer surface is somewhat damaged. For this reason, a touch up process can be simplified and the coating compound can be saved. That is, the productivity of the can lid can be improved according to the present invention.

DETAILED DESCRIPTION OF THE PREFERRED EMBODIMENT

According to an easy open can lid 1 of the present invention, a separated tab 4 for an opening operation of the can lid 1 is fixed on a main body where a panel portion 3 as an upper wall of a can container is formed. The main body is formed by pressing a thin metal sheet such as a surface-treated metal sheet, an aluminum alloy sheet or the like. At least an inner surface 2 of the main body to be contacted with the contents is coated with a not shown resin coating.

Figure 1:
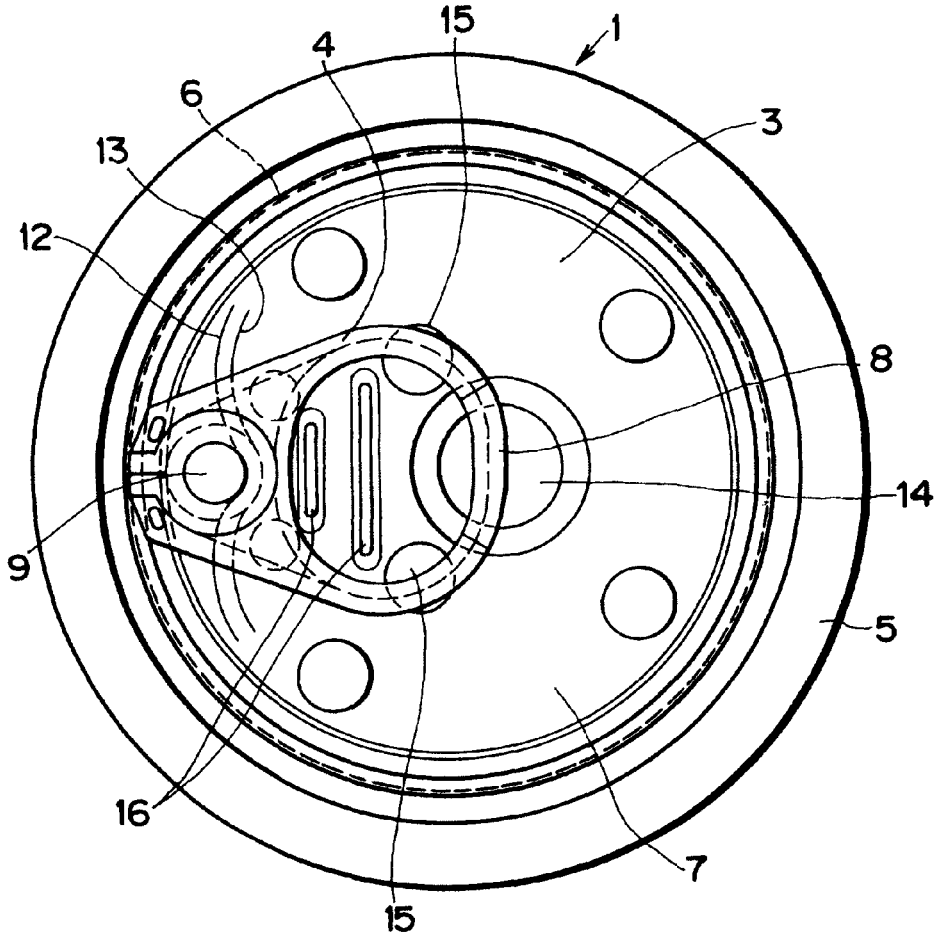
FIG. 1 is a front view showing a can lid of the invention.
Figure 2:
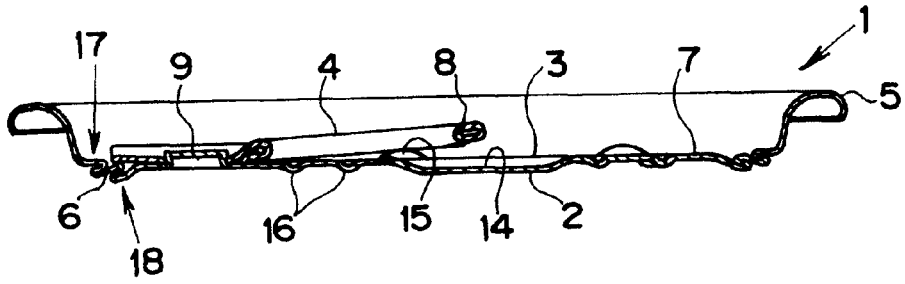
FIG. 2 is a longitudinal sectional view of the can lid.
Figure 3:
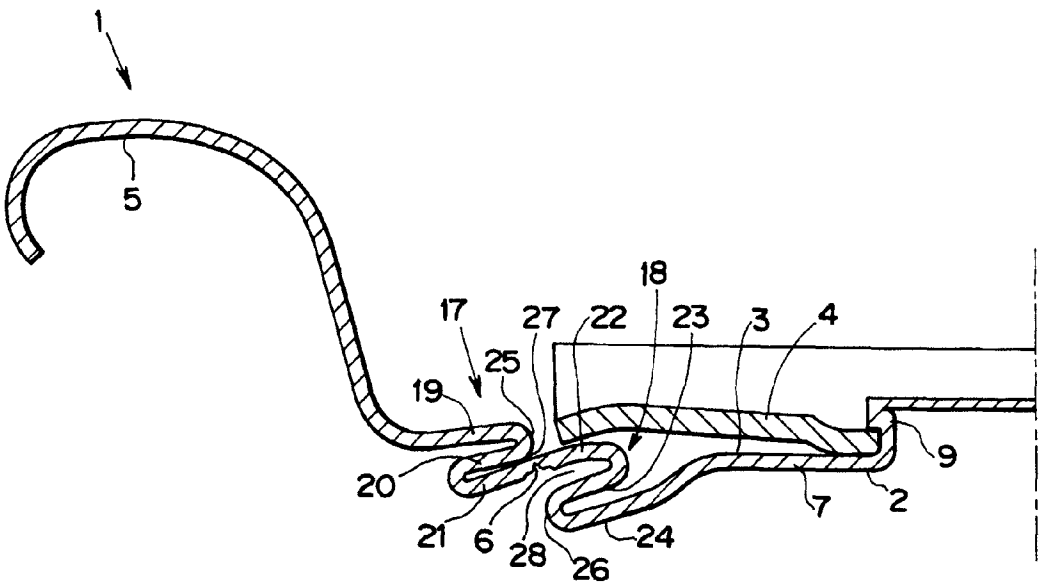
FIG. 3 is an enlarged sectional view showing a peripheral portion of the can lid.

As illustrated in FIG. 1, the panel portion 3 is a substantially disc shaped portion occupying the majority of a central portion of the can lid 1, and a flange portion 5 for fixing a not shown can trunk is formed integrally around the panel portion 3. Also, a substantially annular score line 6 is drawn all around a periphery of the panel portion 3. As illustrated in FIGS. 2 and 3, the score line 6 is drawn on an outer circumference of the inner surface 2. As explained later, the score line 6 is a line to be ruptured, accordingly, a portion inside of the score line is an opening piece 7.

The tab 4 is fixed on a predetermined portion of the opening piece 7 near the peripheral edge. A function of the tab 4 is to rupture a portion of the score line by a principle of leverage when it is lifted. The opening piece 7 is then detached from the can lid 1 when the opening piece 7 is further lifted to rupture the score line 6 entirely. For this purpose, a ring-shaped finger grip portion 8 is formed in one of the end sides of the tab 4, and the other end side thereof is contacted with an upper surface of the opening piece 7 in the vicinity of the score line 6. Additionally, the tab 4 is fixed with the opening piece 7 by a rivet 9 formed by projecting a portion of the panel portion 3. This fixing structure is known in the art. Specifically, the rivet 9 is formed into a bottomed cylindrical shape by projecting a portion of the panel portion 3 near the peripheral edge, and the rivet 9 is fitted into a fixing hole of the tab 4. The rivet 9 is then caulked by pressing the rivet 9 vertically to be fixed with the opening piece 7.

Figure 4:
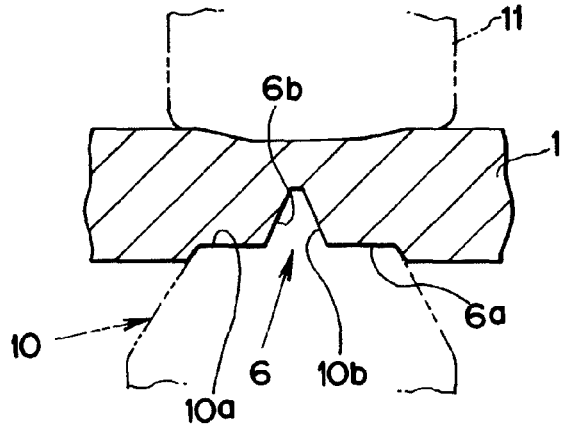
FIG. 4 is a sectional view showing a sectional shape of the score line.

Here will be explained a cross-sectional shape of the score line 6. As illustrated in FIG. 4, the score line 6 comprises a shallow trapezoidal and wide-width first notch 6*a*, and a tapered trapezoidal second notch 6*b* formed on the center of the first notch 6*a*. The reason to shape the score line 6 into the above-explained shape is to prevent the score line 6 from being damaged or constricted partially due to a stress concentration during a forming process of the score line 6.

For this purpose, a leading end of a forming tool for forming the score line 6 is shaped into a corresponding shape to the sectional shape of the score line 6. An example of the shape of the forming tool for forming the score line 6 is also shown in FIG. 4. A trapezoidal and wide-width pressing portion 10*a* is formed on a leading end of a score die 10, and a contour of the pressing portion 10*a* corresponds to the first notch 6*a*. Also, a tapered trapezoidal projecting portion 10*b* is formed on the widthwise center of the pressing portion 10*a*, and a contour of the projecting portion 10*b* corresponds to the second notch 6*b*. A score anvil 11 is positioned on the surface opposite to the score die 10 to function as a pedestal when the score die 10 presses the can lid 1. For this purpose, a leading end of the score anvil 11 to be contacted with the outer surface of the can lid 1 is shaped into a wide trapezoidal shape. Thus, the score line 6 is formed by pressing the can lid 1 from both surfaces using the score die 10 and the score anvil 11.

Since the score line 6 is drawn on the inner surface 2 of the can lid 1 coated with a resin film, the resin film is damaged during the forming process of the score line 6. Therefore, in order to prevent a corrosion of the metal in the vicinity of the score line 6 resulting from a direct contact with the contents, a coating compound is applied to touch up the score line 6. Such a touch up work of the coating is required only for the inner surface 2 of the can lid 1 where the score line 1 is drawn.

Here, the score line 6 thus far explained is drawn circularly all around the panel portion 3, however, the score line 6 may also be arcuate for opening at least a half area of the panel portion 3. Specifically, in order not to detach the opening piece 7 completely from the can lid 1 when the can lid 1 is opened, the score line 6 may be partially omitted, or a residual thickness of the score line 6 may be partially thicker than that of the remaining portion.

In order to ease a lifting of the tab 4 at an initial phase of the opening operation of the can lid 1, an auxiliary score line 12 is drawn on the surface of the panel portion 3. Specifically, the auxiliary score line 12 extends to both sides of the rivet 9 in the direction perpendicular to a not shown longitudinal center line of the tab 4, and enclosing half around the rivet 9 in the center side of the can lid 1. Additionally, the auxiliary score line 12 is rupturable. In the example illustrated in FIG. 1, a sub-score line 13 is also drawn along the auxiliary score line 12. The sub-score line 13 is not to be ruptured even when the tab 4 is lifted up. The function of the sub-score line 13 is to prevent the auxiliary score line 12 from being damaged or constricted partially due to a stress concentration during a forming process of the auxiliary score line 12.

Further, in the opening piece 7 of the panel portion 3, there are formed a recessed portion 14 for enhancing a stiffness of the panel portion 3 as well as for assisting a finger to hook on the finger grip portion 8 of the tab 4, a projection 15 abutting on an lower face of the tab 4 for creating a space between the tab 4 and the panel portion 3, rib-shaped recessed portions 16 for enhancing a stiffness of the panel portion 3, and so on.

The can lid 1 of the present invention further comprises characteristic features as explained in the following. Specifically, in the periphery of the panel portion 3, an outer multilayered portion 17 situated radially outside of the score line 6, and an inner multilayered portion 18 situated radially inside of the score line 6. The outer multilayered portion 17 comprises an annular first outer layer 19 extending inwardly in the radial direction from the flange portion 5, an annular second outer layer 20 extending outwardly in the radial direction from a downward folding portion of the first outer layer 19 situated in the vicinity of the score line 6, and an annular third outer layer 21 extending inwardly in the radial direction from a downward folding portion of the second outer layer 20. Meanwhile, the inner multilayered portion 18 comprises an annular first inner layer 22 extending inwardly in the radial direction from the score line 6, an annular second inner layer 23 extending outwardly in the radial direction from a downward folding portion of the first inner layer 22, and a third inner layer 24 extending inwardly in the radial direction from a downward folding portion of the second inner layer 23.

Thus, the score line 6 is drawn on the inner surface 2 side between the third outer layer 21 and the first inner layer 22.

An outer folding portion between the first outer layer 19 and the second outer layer 20 situated above the score line 6 is flush with the score line 6 in the radial direction or situated slightly outward of the score line 6 in the radial direction. That is, the outer folding portion between the first outer layer 19 and the second outer layer 20 functions as an outer protection portion 25 for covering an edge of the ruptured score line 6. On the other hand, an inner folding portion between the second inner layer 23 and the third inner layer 24 situated below the score line 6 is flush with the score line 6 in the radial direction or situated slightly inward of the score line 6 in the radial direction. That is, the inner folding portion between the second inner layer 23 and the third inner layer 24 functions as an inner protection portion 26 for covering an edge of the ruptured score line 6.

According to the can lid 1 thus structured, both leading edges of the outer protection portion 25 and the inner protection portion 26 do not extend beyond the score line 6. Therefore, both protection portions 25 and 26 will not be contacted with the edge of the ruptured score line 6 opposing thereto at the opening operation of the can lid 1. For this reason, not especially large force is required to open the can lid 1 so that the openability of the can lid 1 is improved. Moreover, the inner protection portion 26 will not disturb a touch up work to apply the coating compound to the score line 6, so that the touch up work can be carried out easily.

In this embodiment, it is especially preferable to keep a distance between the leading edge of the outer protection portion 25 and the score line 6, and a distance between the inner protection portion 26 and the score line 6 within a range of 0 to 1 mm. Consequently, the protection portions 25 and 26 will not be contacted with the edge of the ruptured score line 6 opposing thereto at the opening operation of the can lid 1. For this reason, the openability of the can lid 1 is improved. Moreover, after the can lid 1 is opened, each protruding length of the edge of the ruptured score line 6 from the outer protection portion 25 and from the inner protection portion 26 can be kept within a range in which a hand or finger of a person who opens the can lid 1 or takes out the contents from the can is not injured by the edge of the ruptured score line 6.

An opening width of an outer interspace 27 between the second outer layer 20 and the third outer layer 21 is kept within a range of 0 to 0.1 mm. More specifically, a shortest distance between radially inner ends of a substantially flat lower surface of the second outer layer 20 and a substantially flat upper surface of the third outer layer 21 is kept within a range of 0 to 0.1 mm. On the other hand, an opening width of an inner interspace 28 between the first inner layer 22 and the second inner layer 23 is kept within a range of 0.05 to 0.5 mm. More specifically, a shortest distance between radially outer ends of a substantially flat upper surface of the second inner layer 23 and a substantially flat lower surface of the first inner layer 22 is kept within a range of 0.05 to 0.5 mm. Thus, the inner interspace 28 is opened wider than the outer interspace 27.

That is, since the outer interspace 27 is relatively narrower, deformation volume of the folding portion between the second outer layer 20 and the third outer layer 21 and of the outer protection portion 25 is increased. Therefore, a work hardening of the outer multilayered portion 17 is increased so that a stiffness of the peripheral portion of the panel portion 3 is enhanced. For this reason, opening force created by the tab 4 is transmitted to the score line 6 efficiently. As a result, the openability of the can lid 1 is improved. On the other hand, since the inner interspace 28 is relatively wider, deformation volume of the folding portion between the first inner layer 22 and the second inner layer 23 and of the inner protection portion 26 is decreased. For this reason, an inner resin coating of the inner multilayered portion 18 is prevented from being damaged during a forming process. As a result, the inner surface of the can lid 1 is prevented from corrosion due to a direct contact with the contents.

Further, since the score line 6 is formed by pressing the score die 10 against the inner surface 2 of the can lid 1, the touch up work of the coating takes place on the inner surface 2 side of the can lid 1. However, the inner interspace 28 of the inner surface 2 side opens relatively wider than the outer interspace 27 of the outer surface side of the can lid 1, therefore, the touch up work of the score line 6 can be carried out easily and certainly.

Furthermore, in case the score line 6 is drawn on the outer surface of the can lid 1, the inner surface 2 side is somewhat damaged as a result of pressing the score anvil 11 thereto when drawing the score line. Therefore, it is necessary to touch up both outer surface of the can lid 1 and the inner surface 2 side in the vicinity of the score line 6 by applying a coating compound. To the contrary, according to the invention, the score line 6 is drawn on the inner surface 2 side of the can lid 1. Therefore, a touch up work is required only for the inner surface 2 of the can lid 1. Meanwhile, since the outer surface will not be contacted with the contents, a touch up work of the outer surface is not necessary to be carried out even if the outer surface is somewhat damaged. For this reason, a touch up process can be simplified and the coating compound can be saved. This means that the productivity of the can lid 1 can be improved.

INDUSTRIAL APPLICABILITY

This invention can be utilized in the field of manufacturing canned beverage and canned foods containing solid contents such as meet or fish, or in the field of manufacturing cans for canned beverages and canned foods.

The invention claimed is:

1. An easy open can lid, comprising:

a panel portion, which is formed of an approximate disc shape, and in which a flange portion for fixing a can trunk is formed integrally on its outer circumference;

an opening piece, which is enclosed by a suborbicular score line drawn near the periphery of the panel portion;

an opening tab, which is fixed near the periphery of the opening piece;

an outer multilayered portion enclosing the panel portion from radially outside of the score line, having an annular first outer layer extending inwardly in the radial direction from the flange portion, an annular second outer layer extending outwardly in the radial direction from a folding portion of the first outer layer situated in the vicinity of the score line, and an annular third outer layer extending inwardly in the radial direction from a folding portion of the second outer layer; and an inner multilayered portion enclosing the panel portion from radially inside of the score line, having an annular first inner layer extending inwardly in the radial direction from the score line, an annular second inner layer extending outwardly in the radial direction from a folding portion of the first inner layer, and a third inner layer extending inwardly in the radial direction from a folding portion of the second inner layer; wherein:

a leading edge of an outer protection portion as a folding portion between the first and second outer layers is situated on an outer surface of the can lid opposite to a surface where the score line is drawn, and flush with the score line in the radial direction or situated radially outside of the score line; and a leading edge of an inner protection portion as a folding portion between the second and third inner layers is situated on an inner surface of the can lid where the score line is drawn, and flush with the score line in the radial direction or situated radially inside of the score line, wherein an opening width of an inner interspace between the first and second inner layers is wider than that of an outer interspace between the second and third outer layers, and wherein the minimum opening width of the inner interspace is kept within a range of 0.05 and 0.5 mm, and the minimum opening width of the outer interspace is kept within a range of zero and 0.1 mm.

2. The easy open can lid as set forth in claim 1, wherein:

a distance between the leading edge of the outer protection portion and the score line in the radial direction, and a distance between the leading edge of the inner protection portion and the score line in the radial direction, are within the range of 0 to 1 mm.

3. The easy open can lid as set forth in claim 1, wherein:

the score line is formed by pressing a score die against the inner surface of the can lid.

4. The easy open can lid as set forth in claim 2, wherein:

the score line is formed by pressing a score die against the inner surface of the can lid.

* * * * *